US007937864B2

(12) United States Patent
Mahajan

(10) Patent No.: US 7,937,864 B2
(45) Date of Patent: May 10, 2011

(54) DEVICE FOR COORDINATING ILLUMINATION OF AN IMAGE AND SOUND ASSOCIATED WITH USE OF THE IMAGE

(76) Inventor: Suresh Mahajan, Rancho Cucamonga, CA (US)

( * ) Notice: Subject to any disclaimer, the term of this patent is extended or adjusted under 35 U.S.C. 154(b) by 0 days.

(21) Appl. No.: 12/165,435

(22) Filed: Jun. 30, 2008

(65) Prior Publication Data

US 2009/0000165 A1 Jan. 1, 2009

Related U.S. Application Data

(60) Provisional application No. 60/937,650, filed on Jun. 29, 2007.

(51) Int. Cl.
*G09F 3/00* (2006.01)

(52) U.S. Cl. ..... 40/455; 40/457; 40/546

(58) Field of Classification Search ..... 40/455, 40/456

See application file for complete search history.

(56) References Cited

U.S. PATENT DOCUMENTS

| | | | | |
|---|---|---|---|---|
| 5,774,861 | A * | 6/1998 | Spector | 704/275 |
| 5,989,098 | A | 11/1999 | Reynolds et al. | |
| 6,236,622 | B1 * | 5/2001 | Blackman | 368/10 |
| 6,615,520 | B2 | 9/2003 | Landers, Jr. et al. | |
| 6,732,641 | B2 | 5/2004 | Fissell | |
| 2004/0150993 | A1 | 8/2004 | McElhaney et al. | |

FOREIGN PATENT DOCUMENTS

| | | |
|---|---|---|
| JP | 10-020794 | 1/1998 |
| JP | 2000-293184 | 10/2000 |
| JP | 2004-077654 | 3/2004 |

* cited by examiner

*Primary Examiner* — Cassandra Davis
(74) *Attorney, Agent, or Firm* — Thorpe North & Western LLP

(57) ABSTRACT

The illumination of a display of a religious, meditative, or ceremonial image is coordinated with sound produced and associated with the use of the image, such as a chant associated with the image. The sound can be produced by the device of the invention in which case the device coordinates the illumination with the sound produced by the device, or the sound can be produced by a user of the device in which case the device coordinates the illumination with the sound produced by the user. The device includes a display for illuminating and displaying the visual image and circuitry for coordinating the illumination of the visual image and the sound associated with use of the image.

9 Claims, 2 Drawing Sheets

DEVICE FOR COORDINATING ILLUMINATION OF AN IMAGE AND SOUND ASSOCIATED WITH USE OF THE IMAGE

RELATED APPLICATIONS

This application claims the benefit of Provisional Application Ser. No. 60/937,650, filed Jun. 29, 2007, and entitled "Device for Producing Sound with Associated Visual Display", incorporated herein by reference.

BACKGROUND OF THE INVENTION

1. Field

The invention is in the field of visual displays, particularly visual displays that produce a visual image along with accompanying sound or in response to sound.

2. State of the Art

In the Hindu religion, the AUM symbol (also written as OM) is a sacred symbol representing spiritual concepts such as the creator. The symbol and the sound associated with the symbol is used in contemplation and prayer with a follower looking at the symbol while listening to the AUM sound or chant and/or saying or chanting the AUM sound. Thus, a follower will sit and look at and contemplate the AUM symbol while listening to someone saying in a long monotone voice, and/or saying himself or herself in a long monotone voice, AUM. This AUM symbol and sound is used in other than religious practices, such as in a meditative manner, as at the start and/or end of yoga sessions, meditation sessions, etc. Other religions, meditation, and/or ceremonial practices may have similar symbols and sounds that are used together.

Various display devices exist that will illuminate an image on a display such as a piece of glass or plastic, see, for example, U.S. Pat. Nos. 6,615,520 and 6,732,641. Further, there are illuminated displays which coordinate a desired sound with a selected particular image or item that is illuminated by a display, see, for example, U.S. Pat. No. 5,989,098 and U.S. Patent Application Publication No. 2004/0150993. However, these displays are not designed to provide a religious, meditative, or ceremonial experience and do not integrate the image, illumination of the image, and associated sound in a manner to create the religious, meditative, or ceremonial experience.

SUMMARY OF THE INVENTION

According to the invention, an illuminated display of a religious, meditative, or ceremonial image is provided wherein the illumination of the image is coordinated with sounds associated with the image. Sound or sounds associated with the image may be produced by the device along with the control of the illumination of the image, or the sound or sounds associated with the image may be produced by the user and sensed by the device and used to coordinate the illumination of the image with the sounds produced by the user. In some embodiments, the illumination of the image and the coordination with the sounds associated with the image can be controlled and adjusted by the user. The device includes a display for illuminating and displaying a visual image of a religious, meditative, or ceremonial symbol and means for coordinating the illumination of the visual image and sound associated with use of the image.

For example, a device of the invention may display the AUM symbol and while displaying the AUM symbol, produce the AUM sound associated with the symbol so that the display can be used in religious, meditative, and/or ceremonial activities which make use of the symbol and sound. In one embodiment of the device, when a start button on the device is operated, the chanting sound of "AUM" will begin and the AUM symbol will be illuminated. The sound will continue for a fixed period of time and will then stop. When the sound stops, the illumination of the symbol will also stop. In another embodiment, when a start button on the device is operated, the chanting sound of "AUM" will begin and the light intensity illuminating the AUM symbol will gradually increase from nothing to maximum brightness over a period of time. The period of time over which the brightness of the illumination increases will usually continue until chanting is completed. Upon completion of the chanting, the illumination will fade away slowly, but more quickly that the illumination increased. The time period of chanting can be set or can be adjusted by the user. For example, the operation of the device can be set so that chanting begins and continues for a period of thirty seconds. The intensity of illumination of the symbol will increase for the thirty seconds that the chanting continues. Upon termination of the chanting, the illumination will decrease over a shorter time period such as about five seconds. Alternately, rather than the display producing the AUM sound or chant, the user will produce the AUM sound or chant while observing or contemplating the AUM symbol. The device will sense the sound produced by the user and will cause illumination of the image during the duration of the sound produced by the user. The illumination may start at a low level upon first sensing of the sound and increase over the time of the sound so that a user can use the device to learn and to practice production of the sound continuously over an extended time period, such as thirty seconds. When the sound produced by the user stops, the illumination will fade away. The display can be used in various modes of operation, and can be provided with a number of user controls so that a user can set or create various modes of operation.

In one embodiment of the invention, the image to be displayed is provided on a transparent or translucent plate display such as a plate of glass or plastic. The plate is inserted into a slot in a base where a light source in the base shines into the plate so that light travels in the plate to the image and illuminates the image. The base will include a sound source, such as a sound chip on which the sound is digitally recorded, and a speaker so that the sound can be played to be heard by a user. The base also includes control circuitry to coordinate the sound and illumination so that when the sound is produced, the image is illuminated. The base can also include a sound sensor such as a microphone to sense sound produced by a user. In such case, the control circuitry can coordinate the sound sensed and illumination of the image so that when the sound is produced by the user and sensed by the device, the image will be illuminated. The illumination can be of one fixed intensity, or can be varied by the control circuitry so as to change in intensity in a desired manner. For example, the illumination can increase in intensity during the period a continuous sound is produced by the user.

THE DRAWINGS

In the accompanying drawings, which show the best mode currently contemplated for carrying out the invention:

DETAILED DESCRIPTION OF THE ILLUSTRATED EMBODIMENTS

The invention is a display for displaying a visual image, such as a religious, meditative, or ceremonial image or symbol, and for coordinating the illumination and audio sound, such as a chant, that is associated with the symbol, such as in a religious, ceremonial, or meditative way. For example, in the Hindu religion, the AUM symbol is a sacred symbol and is used in contemplation and prayer with a follower looking at the symbol while listening to the AUM sound or chant and/or saying or chanting the AUM sound. A follower can sit and look at and contemplate the AUM symbol while listening to someone saying in a long monotone voice, or saying himself or herself in a long monotone voice, AUM. The invention provides coordination between the illumination of the AUM symbol and the saying or chanting of the AUM sound.

Figure 1:
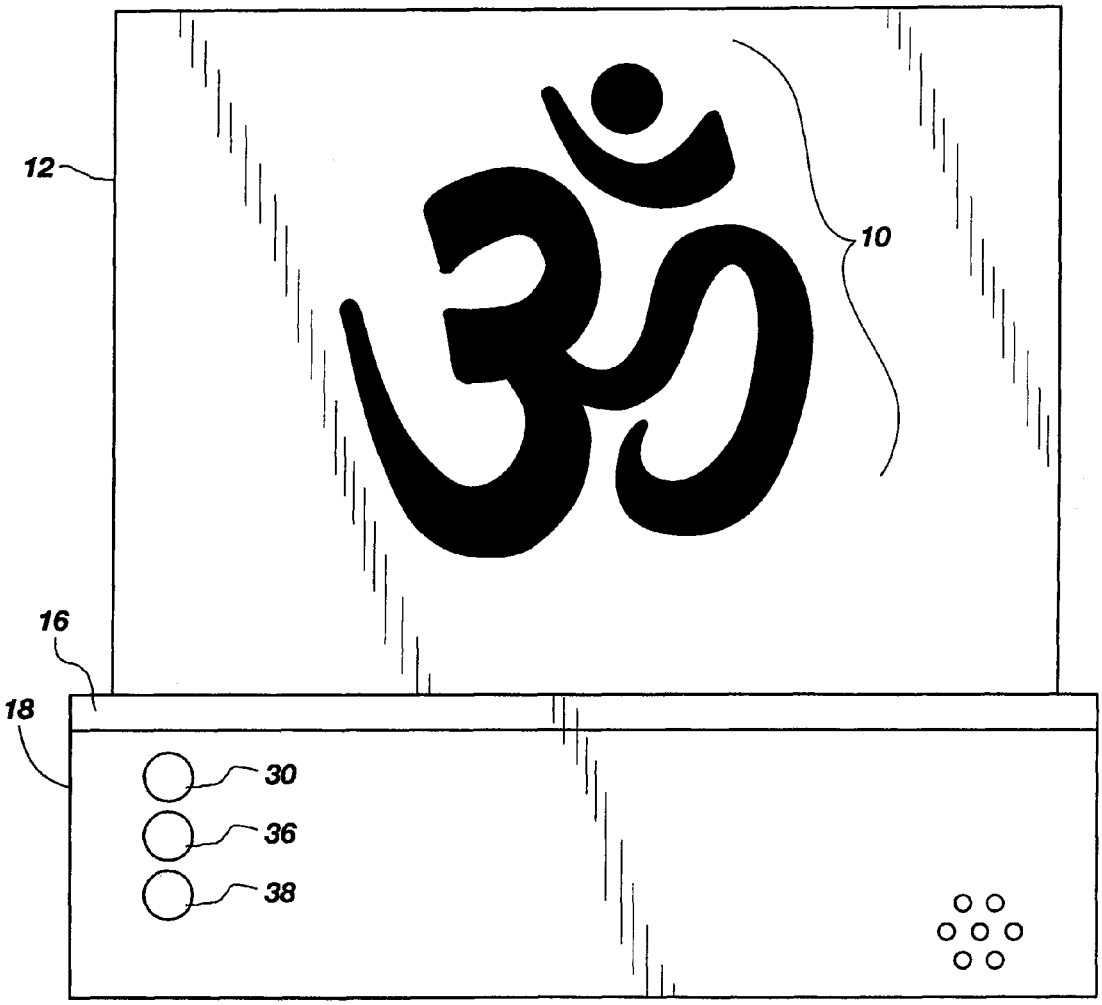
FIG. 1 is a front elevation of a device of the invention.
Figure 2:
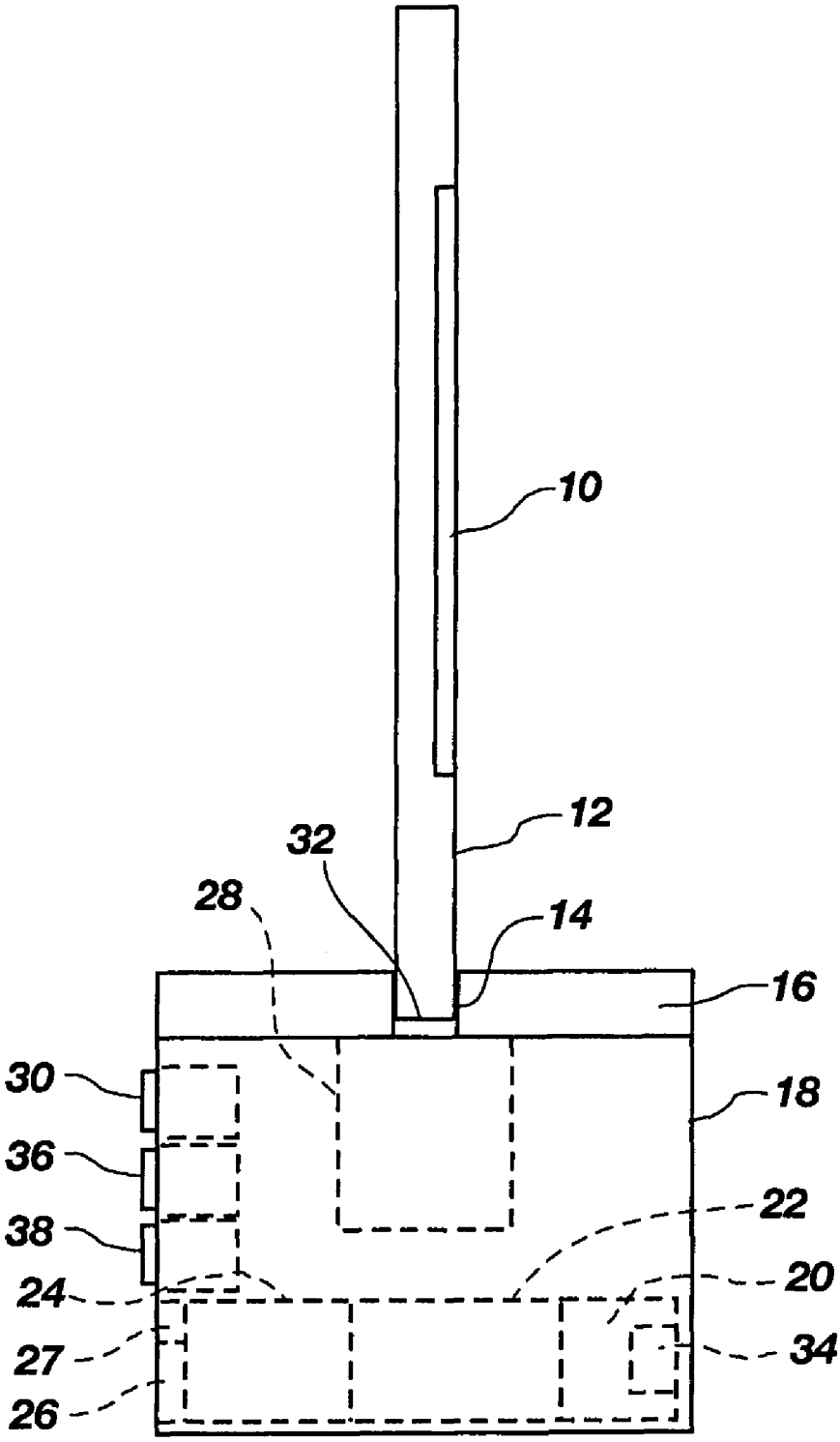
FIG. 2 is a right side elevation of the device of FIG. 1. Components housed in the base of the illustrated device are shown in broken lines.

Referring to the example embodiment of the invention shown in FIGS. 1 and 2, the AUM symbol 10 can be etched, such as by sandblasting, into a plate 12, such as a high quality crystal glass plate of about three-quarter inch thickness, which is inserted vertically in a slot 14, FIG. 2, in a top 16 of a base 18. The base top 16 may be a horizontal 'tile' made of marble or granite, depending upon customer selection. Underneath this top tile, within base 18, will be a power source 20, such as rechargeable batteries, control circuitry 22, a sound source such as a solid-state recorder or solid state sound chip 24, a speaker or speakers 26, a microphone or other sound sensor 27, a light source 28, such as an LED lighting board or various types of light bulbs, and other components such switches, connectors, a control keyboard, a control display, etc. For example, the base 18 may include a push button start switch 30 accessible to a user. The light source 28 in the base is arranged to shine light onto the edge 32 of glass plate 12 so as to travel up through the glass plate and illuminate the symbol 10. The light can be of any desired pre-selected color or can be made so that the user can select a desired color or change selected colors. A power cord receptacle 34 may be provided to plug in a power cord to connect to a standard wall socket to provide power when needed to recharge batteries or to provide power for the power supply if batteries are not used or are used only for backup purposes. Of course, removable batteries, rechargeable or non-rechargeable, could be used, if desired, so that the device will function fully without any external connections. When the AUM symbol is used as the image, the chanting sound of AUM will be recorded and stored in the solid state recorder or sound chip 24 (alternatively, other memory in the device can be used for sound storage) and can be played through speaker 26. Alternately, when the user produces the AUM sound, the sound can be sensed by microphone or other sensor 27 and used by control circuitry 22 to control light source 28 to control the illumination of the image. The device can be portable, free standing, or wall mountable.

While the display for the illustrated embodiment has been described as plate glass with the symbol etched into the glass by sandblasting, various other methods of etching the symbol into the glass may be used and various other materials, such a plastic, can be used for the plate 12. Further, the design can be printed onto the plate, such as by screen printing, without etching, or the ink used in the printing of the symbol can cause the symbol to be etched into the plate as described by the prior art patents previously cited. Further, the light source can shine the light into an edge of the plate 12 or the light source can extend into an edge of the plate. In addition, the symbol can be displayed and illuminated in other ways. Also, the base can be constructed in various ways. The use of the tile for the top of the base along with the heavy glass plate for the display will be used in high quality versions of the device, particularly where the device is used in a home as the center for family worship or meditation, or for other ceremonial use.

The device of the invention can be made in various sizes and with various features. The device can even be made in a small personal size to be carried with a user, and can be provided in a size for use as a key ring. The user can customize the product by size of the display, color of lighting of the symbol, and selection of tile, material, and colors. Example sizes and features for example products that could be supplied are shown in the following table.

| Model # | Color of Display | Material/Color of Tile | Mounting | Size of display | Size of tile | 'learn mode' | Remote Control |
|---|---|---|---|---|---|---|---|
| I | O/R/B/W | Marble/Granite White/Black | Table Top | 8 × 11 in. | 12 × 12 in. | no | No |
| II | Same | Same | Table Top | 4/6<br>8 × 11<br>11 × 14 | 8 × 8<br>12 × 12<br>15 × 15 | No | Yes |
| III | Dial in color | Add more shades | Table Top | 4/6<br>8 × 11<br>11 × 14 | 8 × 8<br>12 × 12<br>15 × 15 | Yes | Yes |
| IV | Holographic display | No | Key Chain Display | 1.5 × 2.5 in. | — | — | — |
| V | O/R/B/W | No | Wall Mounting | 2' × 3' | — | Yes | Yes |

While the device illustrated could merely have a switch or switches to turn on and off the light source for the display and the sound source for producing the sound, either together or separately, so that no additional control circuitry would be needed, it will generally be desirable to provide control circuitry which may be hard wired circuitry to perform certain preset functions or which will include a microprocessor so that various different control functions can be programmed into the microprocessor to control operation of the device. The microprocessor can control operation of the device according to selected preprogrammed operation modes for the device as selected by a user, or may allow the user to program the desired operation. Further, the microprocessor can allow the user to set and change various operating parameters for the preprogrammed modes of operation for the device, such as the time during which the sound is produced and the time during which the illumination of the device decreases once sound production, either by the device or by the user, ceases. Buttons 36 and 38 can be provided, for example, to be operated by a user to interface with the control circuitry to make changes in various operational settings or to change operational modes of the device. Additional buttons and/or a key pad could be provided along with a display, if desired for control and programming of the device. A remote control feature with a remote controller device, similar to a television remote controller device, can be provided. In addition, a clock can be provided in the device so that a user can set the device to begin operation at set times, similarly to setting a clock radio.

Examples of possible operating modes for the device are:

1. When on/off switch 30 is turned on in one mode, the symbol will be lighted to a desired or preset brightness with no sound. Alternatively, the user will be able to set the brightness of the light, by operation of a knob or push button.
2. When the start button 30 is depressed in another mode of operation, the chanting sound of "AUM" will begin and the light intensity lighting the symbol will gradually increase from nothing to maximum brightness over a period of time. The period of time over which the brightness of the illumination increases will usually continue until chanting is completed. Upon completion of the chanting, light will fade away slowly. The time period of chanting can be set or can be adjusted by the user. For example, the operation can be set so that chanting begins and continues for a period of thirty seconds. The illumination of the symbol will increase for the thirty seconds that the chanting continues. Upon termination of the chanting, the illumination will decrease over a shorter time period such as about five seconds. This operation can be one time, initiated by operation of the start button 30, and reinitiated when desired by the user by again pressing the start button, or, once initiated, the operation can repeat at preset time intervals, which can be factory set or set by the user, until such operation is stopped by the user, such as by operation of the start button.
3. A "learn" mode of operation can be provided where the user depresses a "learn" button, and he or she can chant AUM. The symbol will become brighter as the chanting, in a single breath, is in progress. As soon as the chanting is interrupted, the symbol will hold its brightness at the time of interruption and then will fade away, slowly. The amount of brightness will be dependent on intensity and duration of the chanting of the user. The "learn" feature will allow a user to provide the AUM chant and will help the user to learn to provide an AUM chant in a single breath. If desired, the recorded AUM chant can be played during the learn mode so the user can copy the recorded chant.

While the invention has been described in connection with the AUM symbol and sound, using same ideas and techniques, different images along with an appropriate recorded "Mantra", can be made for various religions or other meditation and ceremonial uses.

The invention also includes a method for coordinating illumination of a religious, meditative, or ceremonial visual image and sound associated with the use of the visual image, which includes the steps of providing a display for displaying a visual image of a religious, meditative, or ceremonial symbol, providing sound associated with use of the image, and illuminating the image during the period during which the sound is provided. Alternately, or in addition, the method includes the steps of providing a display for displaying a visual image of a religious, meditative, or ceremonial symbol, sensing when sound associated with use of the image is produced, and illuminating the image during the period during which the sound is sensed.

Whereas the invention is here illustrated and described with reference to embodiments thereof presently contemplated as the best mode of carrying out the invention in actual practice, it is to be understood that various changes may be made in adapting the invention to different embodiments without departing from the broader inventive concepts disclosed herein and comprehended by the claims that follow.

The invention claimed is:

1. A device for coordinating illumination of a religious, meditative, or ceremonial visual image and sound associated with the use of the visual image, comprising:

a display for illuminating and displaying a visual image of a religious, meditative, or ceremonial symbol;

means for producing sound;

control circuitry for coordinating the illumination of the visual image and sound associated with use of the image; and wherein the control circuitry is adapted to be configured to cause production of sound for a predetermined sound time interval and to cause an increase in the intensity of the illumination of the image during the predetermined sound time interval, and to cause a decrease in the illumination of the image during a predetermined decrease time interval after the predetermined sound time interval, wherein the predetermined decrease time interval is adjustable by a user.

2. A device for coordinating illumination of a religious, meditative, or ceremonial visual image and sound associated with the use of the visual image, according to claim 1, wherein the control circuitry includes a microprocessor.

3. A device for coordinating illumination of a religious, meditative, or ceremonial visual image and sound associated with the use of the visual image, according to claim 1, wherein the predetermined sound time interval is adjustable by a user.

4. A device for coordinating illumination of a religious, meditative, or ceremonial visual image and sound associated with the use of the visual image, comprising:

a display for illuminating and displaying a visual image of a religious, meditative, or ceremonial symbol;

means for producing sound;

control circuitry for coordinating the illumination of the visual image and sound associated with use of the image;

wherein the control circuitry is adapted to be configured to cause production of sound for a predetermined sound time interval and to cause an increase in the intensity of the illumination of the image during the predetermined sound time interval, and to cause a decrease in the illumination of the image during a predetermined decrease time interval after the predetermined sound time interval;

means for sensing sound used in association with the religious, meditative, or ceremonial use of the image; and switch means having at least two conditions, wherein the control circuitry is configured, in one condition of the switch means, to cause production of sound for a predetermined sound time interval and to cause an increase in the intensity of the illumination of the image during the predetermined sound time interval, and to cause a decrease in the illumination of the image during a predetermined decrease time interval after the predetermined sound time interval, and in another condition of the switch means, to control the illumination of the image in response to the sound sensed.

5. A device for coordinating illumination of a religious, meditative, or ceremonial visual image and sound associated with the use of the visual image, according claim 4, wherein, when the switch means is in condition to configure the control circuitry to control the illumination of the image in response to the sound sensed, the control circuitry is configured to cause illumination of the image during the period that sound is sensed by the means for sensing sound.

6. A device for coordinating illumination of a religious, meditative, or ceremonial visual image and sound associated with the use of the visual image, according to claim 5, wherein, when the control circuitry is configured to cause illumination of the image during the period that sound is sensed by the means for sensing sound, the control circuitry is configured to cause an increase in the intensity of the illumination of the image based upon the length of time during which continuous sound is sensed.

7. A device for coordinating illumination of a religious, meditative, or ceremonial visual image and sound associated with the use of the visual image, according to claim 6, wherein when the control circuitry is configured to cause an increase in the intensity of the illumination of the image based upon the length of time during which continuous sound is sensed, the control circuitry is also configured to cause a decrease in the illumination of the image during a predetermined second decrease time interval when sensing of sound stops.

8. A device for coordinating illumination of a religious, meditative, or ceremonial visual image and sound associated with the use of the visual image, according to claim 7, wherein the predetermined second decrease time interval is adjustable by a user.

9. A device for coordinating illumination of a religious, meditative, or ceremonial visual image and sound associated with the use of the visual image, according to Claim 4, wherein the control circuitry includes a microprocessor.

* * * * *